US006206787B1

(12) United States Patent
Kleppen

(10) Patent No.: US 6,206,787 B1
(45) Date of Patent: Mar. 27, 2001

(54) GOLF TRAINING DEVICE

(76) Inventor: Arthur L. Kleppen, 14221 SE. 266th, Kent, WA (US) 98042

( * ) Notice: Subject to any disclaimer, the term of this patent is extended or adjusted under 35 U.S.C. 154(b) by 0 days.

(21) Appl. No.: 09/415,135

(22) Filed: Oct. 8, 1999

Related U.S. Application Data

(63) Continuation-in-part of application No. 09/292,929, filed on Apr. 16, 1999.

(51) Int. Cl.[7] ..... A63B 69/36
(52) U.S. Cl. ..... 473/207; 473/212; 473/220
(58) Field of Search ..... 473/212, 207, 473/220, 227, 215, 266, 276, 277

(56) References Cited

U.S. PATENT DOCUMENTS 4,892,317 * 1/1990 Corder ..... 473/212
4,960,280 10/1990 Corder, Jr. ..... 273/189 R
5,269,528 * 12/1993 McCardle ..... 473/220
5,441,271 * 8/1995 Briggs ..... 473/212
5,529,306 6/1996 Staats et al. ..... 473/208
5,586,761 * 12/1996 Brock et al. ..... 473/207
5,649,884 * 7/1997 Manalo ..... 482/91
5,718,640 * 2/1998 Noblin ..... 473/212
5,890,968 * 4/1999 Mingo ..... 473/207
5,951,408 * 9/1999 Inman ..... 473/212

* cited by examiner

*Primary Examiner*—Mark S. Graham
*Assistant Examiner*—Raeann Gordon
(74) *Attorney, Agent, or Firm*—Keith D. Gehr

(57) ABSTRACT

The invention is a training device to enable a golfer to develop a smooth and consistent swing. It comprises a harness with a chest encircling band and shoulder straps, somewhat similar to a brassiere. A rigid bar is attached transversely and retained in the rear portion of the shoulder straps. The bar is of a sufficient length and positioned so that in use it is essentially horizontal across the shoulders and not visible to a golfer addressing a ball. However, one end becomes visible directly in front of the golfer at the peak of a correct back swing and the other end becomes visible in front of the golfer at the end of a proper follow through. Golf professionals will find the device useful as a teaching aid.

6 Claims, 7 Drawing Sheets

GOLF TRAINING DEVICE

This application is a continuation-in-part of application Ser. No. 09/292,929, filed Apr. 16, 1999.

BACKGROUND OF THE INVENTION

Golf is a sport that has been popular for several centuries. Today it is embraced by millions—young and old, men and women, and people from wealthy to those of very limited means. Most golfers soon develop a very high dedication to their sport. Many "duffers" are content with mediocre scores and principally enjoy the chance for an outing and the companionship of those with whom they play regularly. However, most enthusiasts work diligently to lower their scores. Often this involves repeated lessons from a professional who can observe the player on a practice course and offer suggestions as necessary to correct his or her swing.

Numerous mechanical devices have been invented that are supposed to help a golfer develop a proper swing. These range from the ridiculous to the very practical. Exemplary among the latter group might be mentioned the restraints described in U.S. Pat. Nos. 4,893,317 and 4,960,280 to Corder, Jr., designed to train a golfer to keep the arms in proper relationship to the torso. A somewhat more complex device is shown in Staats et al., U.S. Pat. No. 5,529,306, intended to maintain a constant distance between the left pectoral muscle and the right forearm (assuming a right handed golfer).

Developing a smooth and consistent swing is one of the principle secrets of lowering one's score. One might imagine an imaginary axis running through the player's head and neck, down through the torso and crotch, and hitting the ground about midway between the feet. Assuming that the golfer is right handed, on the back swing the torso and hips rotate to the right around this axis while the head is essentially stationery. The feet remain in position but the weight is transferred to the right foot and the left heel is raised. On the forward swing this torso rotation is reversed. After impacting the ball, torso rotation continues to the left during the follow through. Weight is transferred to the left foot and the right heel elevates. Head position should be essentially stationary until the very end of the follow through. Both feet remain in their original location throughout. While there is necessarily some rotation of the hips, this is accompanied by maximum rotation of the spine, particularly the lumbar region.

As simple as this movement sounds, it requires precise muscle coordination akin to that of a trained dancer and is something that a surprising number of golfers fail to master. Like a dancer or competitive diver, the movement should ultimately become so well programmed and automatic that the golfer does not even think about it when hitting the ball.

Available time on golf courses tends for most people to be limited and relatively expensive. Thus anything that can be done at home or on a practice range to increase enjoyment on the course is welcome. The devices noted above are intended to serve that purpose. However, none specifically address well the matter of overall swing, particularly proper trunk rotation. The present invention is directed to that end and is a training and exercise device to assist a golfer in developing a smooth, accurate, and consistent swing. Golf professionals will also find the invention of significant value as a teaching device.

SUMMARY OF THE INVENTION

The present invention is a coordination training and exercise device for golfers. It is particularly useful in training body muscles of a golfer in order to have a sooth and correct swing that is consistent time after time. The device is a combination of a chest harness and position indicator bar. The chest harness is constructed in the manner of a brassiere with a chest encircling band supported in position by shoulder straps. The band will have a front closure which may be a buckle, Velcro, hooks and eyes, or functionally similar devices. The indicator bar is affixed to the back of the shoulder straps by small loops or other means so that it is in a generally horizontal position when the wearer is addressing a real or imaginary golf ball. The bar is not visible to the wearer when in the ball addressing position. However, it is of a length so that if body rotation is correct, at the height of the backswing one end appears directly in front of the wearer about waist high. If the golfer is right handed this will be the left end of the bar. At the end of a correct follow through the opposite end will be similarly positioned. The exact length of the bar is not critical but about 4 feet is generally suitable.

One of the many problems of form often experienced by beginning golfers is moving the upper arm up and away from the body during the back swing. In essence, arm movement partially replaces or does not coordinate well with trunk rotation. The golfer may be trained to correct this fault with one embodiment the present device. An auxiliary strap may be attached to the chest band so as to enclose one arm and maintain it in proper relationship to the trunk during the swing. For a right handed golfer the left arm would be so restrained. Other devices that serve this particular purpose are known, but none have heretofore been constructed so as to be used in the present manner.

One embodiment of the present training device includes adjustable light pointers to show a visible trace on the ground as the swing progresses as a further means of improving technique.

While one does not need to be in the peak of physical condition to play golf, certain muscle groups are repeatedly utilized and off-course exercises to strengthen those muscles are beneficial. Back and shoulder muscles in particular are important and poorly conditioned golfers are frequently subject to lower back complaints. The present invention in another embodiment can also serve as an exercise device to strengthen the critical muscle groups. Elastic strips or tubing can be affixed to each end of the bar. The outer or distal ends of the elastic have an anchoring means, such as a loop or an eye, that may be affixed to spaced apart locations such as opposing walls. By practicing swings with the harness and bar in place, the elastic offers resistance by which the appropriate muscle groups can be significantly strengthened.

It is an object of the invention to provide a golf training device that will help a golfer develop a correct, smooth, and consistent swing.

It is an additional object to provide a device that is useful to the golf professional as a teaching tool.

Another object of the invention is to provide a device that shows a visible light trace on the ground as a means for analyzing the golfer's swing.

It is a further object to provide an exercise device that strengthens the muscles used in golfing.

These and many other objects will become readily apparent upon reading the following detailed description taken in conjunction with the drawings.

BRIEF DESCRIPTION OF THE DRAWINGS

FIG. 3 shows a golfer about half way through her follow through.

FIG. 4 shows the golfer at the end of the follow through.

DETAILED DESCRIPTION OF THE PREFERRED EMBODIMENTS

Figure 1:
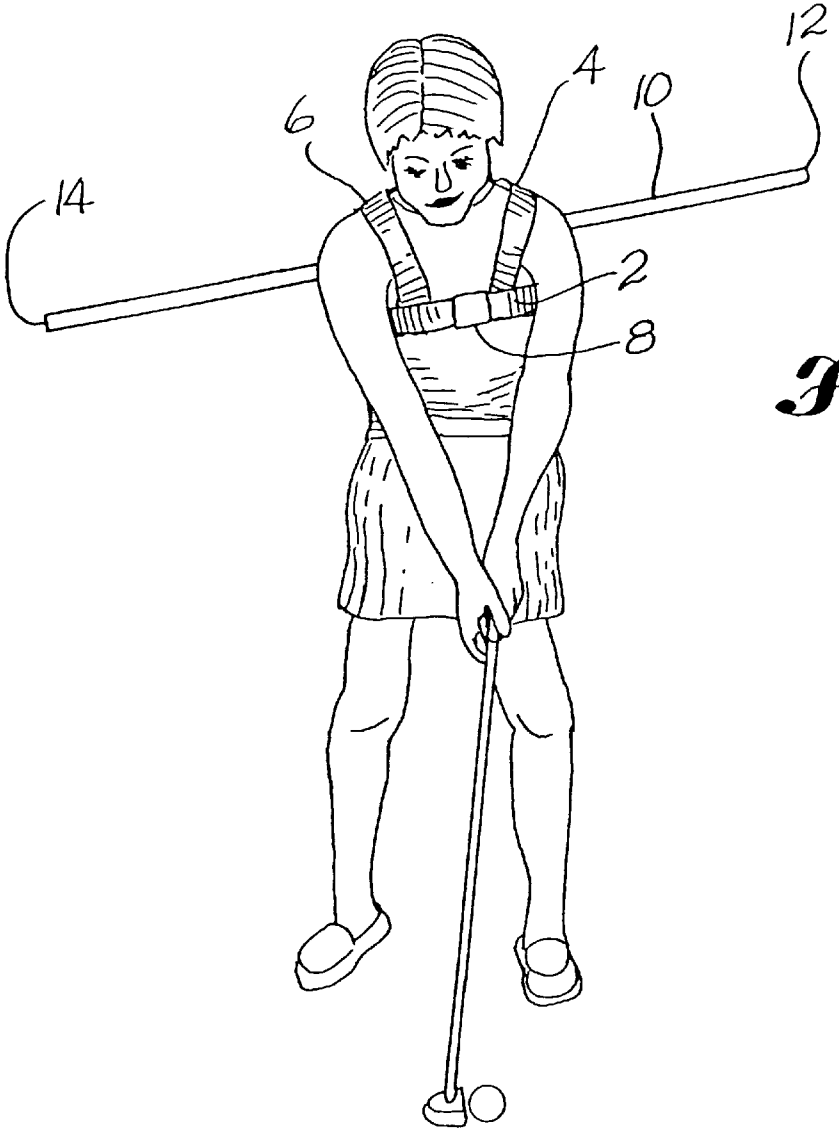
FIG. 1 is a representation of a golfer addressing or hitting a ball while wearing the training device.

Reference to the drawings will readily show how the present training device is constructed and used. In FIG. 1 is seen a golfer in the position where she would be addressing a real or imaginary ball. A chest encircling band 2 is supported by shoulder straps 4, 6 and is closed by a buckle 8 or similar closure means. The closure may alternatively be in another location on band 2. A light weight rod 10, approximately four feet in length and having a left end 12 and right end 14, is retained by the rear portion of the shoulder straps 4, 6. The rod is preferably held in loops on the shoulder straps for easy insertion or removal. However, it may be permanently held in place by rivets or similar fasteners. In the ball addressing or contacting position of FIG. 1 the rod is approximately horizontally disposed and should not be visible to the golfer.

Figure 2:
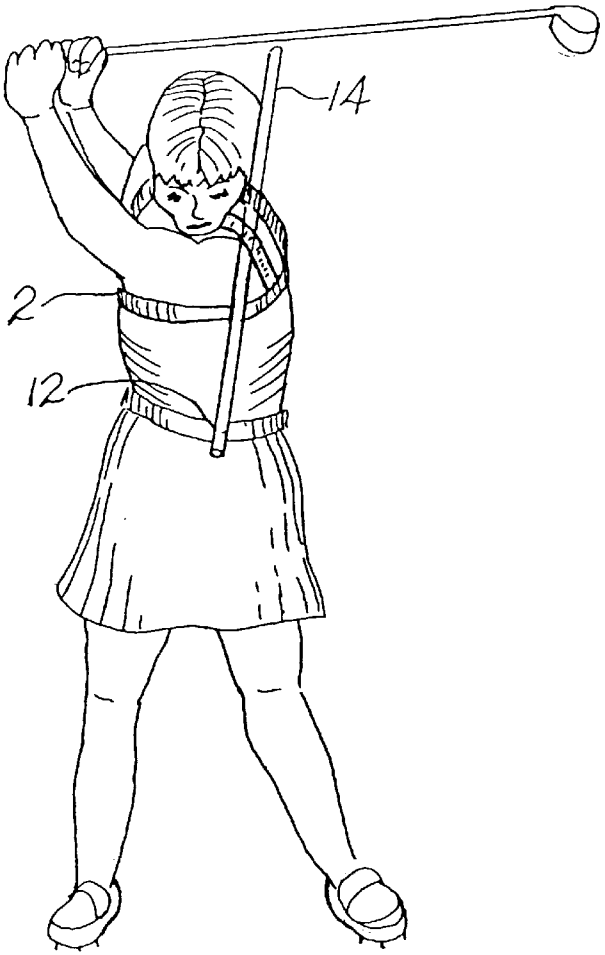
FIG. 2 represents a golfer at the peak of her backswing.

FIG. 2 shows the position of the golfer at the height of the backswing. Assuming that the golfer is right handed, as is shown in the figures, the left end 12 of the rod should be located directly in front of the golfer at about waist height. If the swing is improperly one of mostly arm movement without accompanying torso rotation the rod tip 12 will either not be visible or will be off to the golfer's left side.

Figure 3:
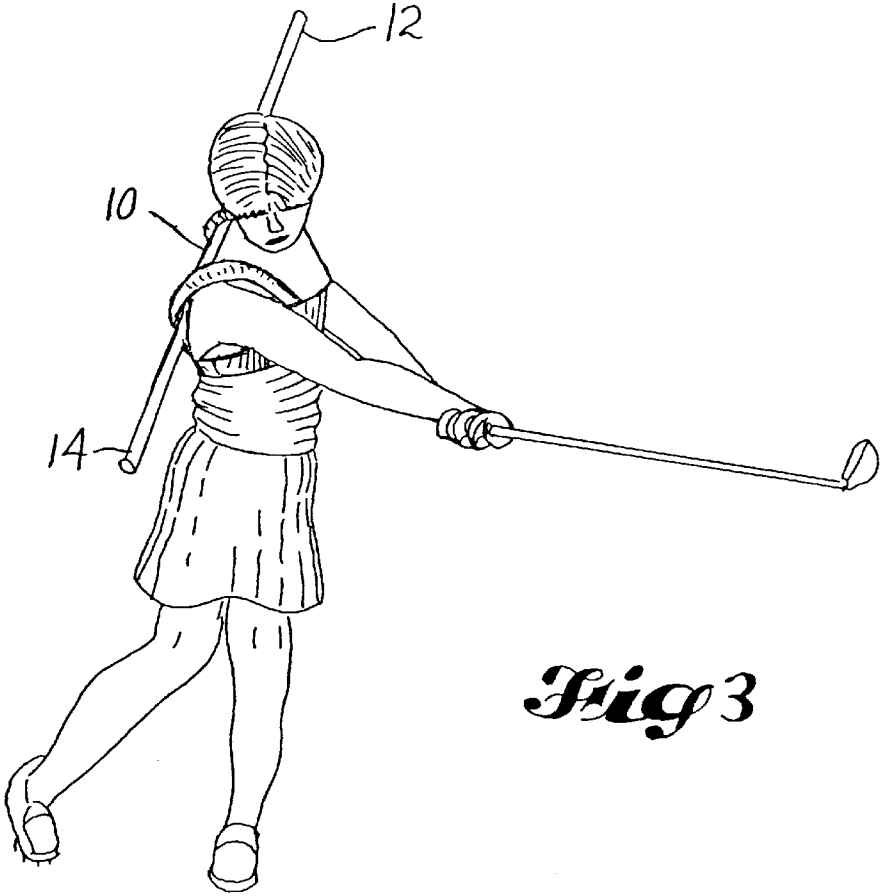
Figure 4:
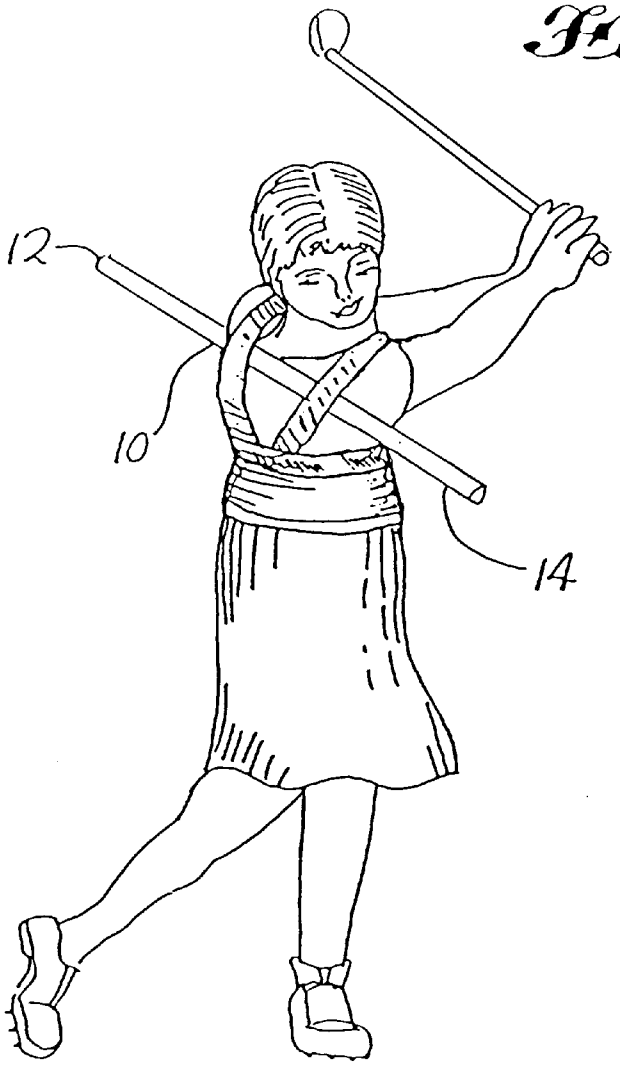

At the real or imaginary point of contact with the ball the positions will again be as shown in FIG. 1. After ball contact the follow through begins. FIG. 3 shows the follow through at about the half way point. The weight is now being transferred to the left foot and the right end 14 of the rod is becoming visible. At the end of a full follow through, seen in FIG. 4, the right end 14 of the rod is again directly in front of the golfer. If the follow through is aborted or not accompanied by proper trunk rotation the rod end 14 will either not be visible or will be off to the golfers right side.

Figure 6:
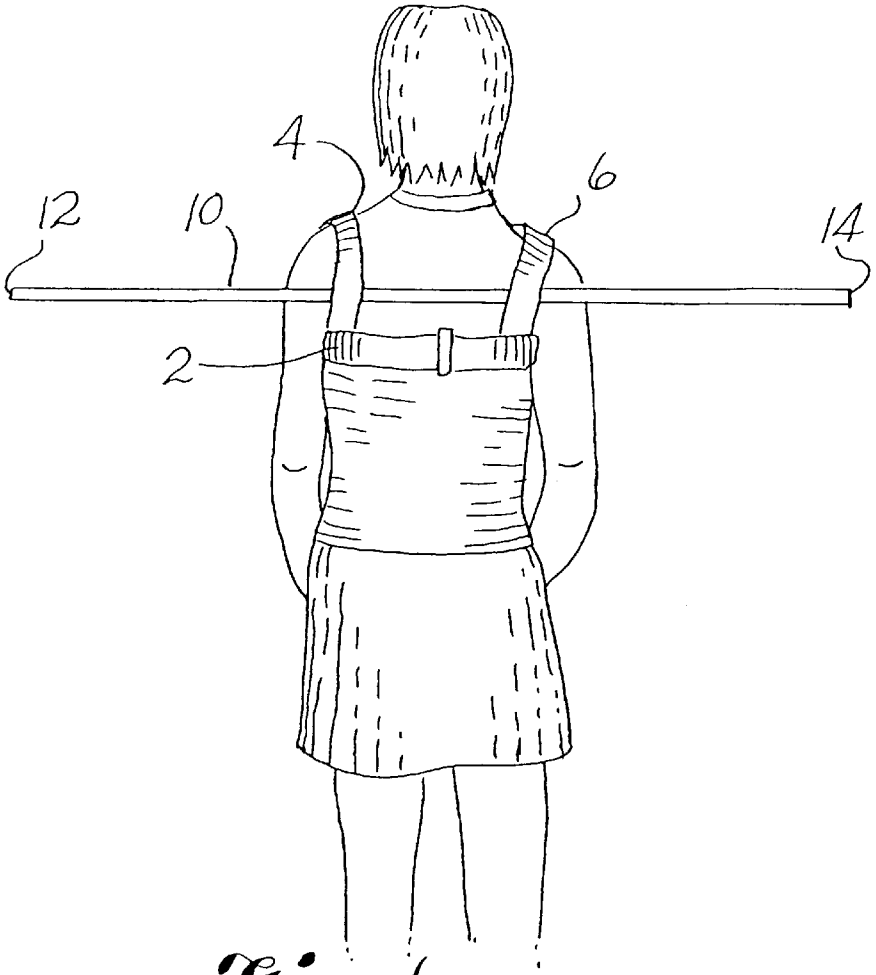
FIGS. 5 and 6 are respectively front and back views of one embodiment of the device.
Figure 5:
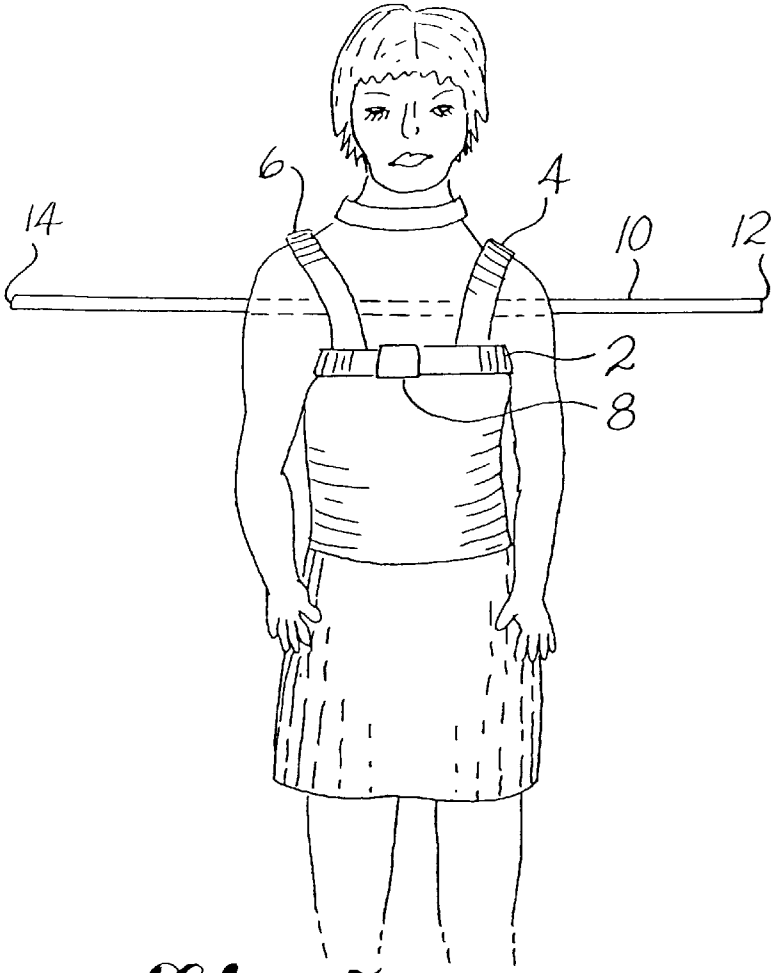

FIG. 5 is a front view of one embodiment of the device shown on a golfer at rest. FIG. 6 shows the same arrangement as seen from behind. Rod 10 is retained in loops, not shown, on the underside of shoulder straps 4, 6.

The chest and shoulder straps may be made of light webbing of any fiber. A width of about 2 inches is suitable for the chest band and somewhat narrower webbing; e.g., 1 to 1½ inches, is suitable for the shoulder straps. These dimensions are not critical.

Figure 7:
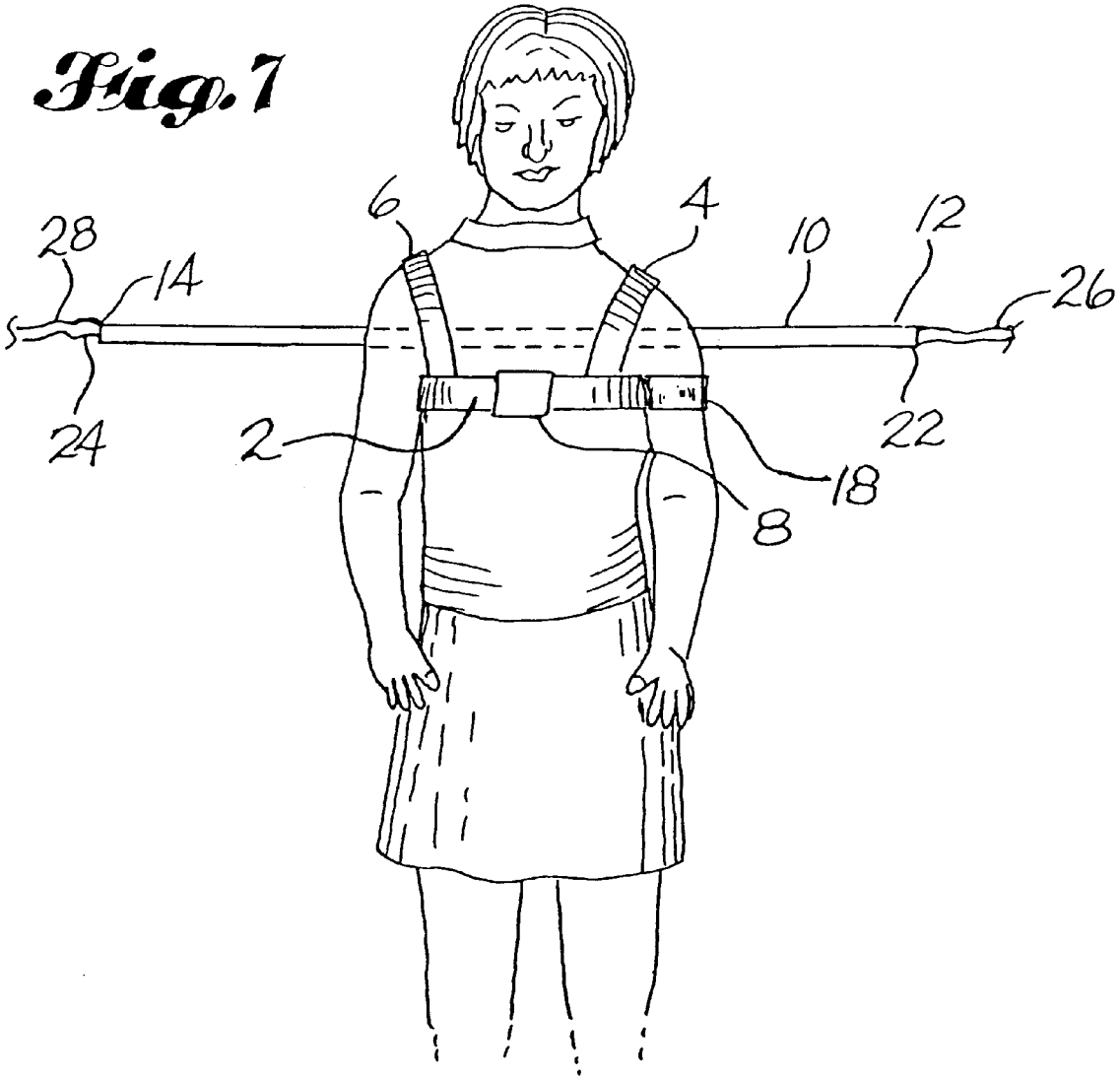
FIG. 7 is a front view of another embodiment of the device used for strengthening appropriate muscle groups.

FIG. 7 is similar to FIG. 6 but displays a variation of the device useful as an exerciser for muscle development. Rod 10 terminates in eyes or similar attachment points 22, 24. Elastic or other resilient means 26, 28 are attached at their proximal ends to the eyes. Gum rubber surgical tubing having a diameter of about ¼ to ½ inch is very suitable although other elastic material or even springs may also be used. The distal ends of the elastic are attached to opposing anchors, not shown; e.g., opposite walls of a garage or similar location. This embodiment of the training device is used in exactly the same manner as was described earlier. The golfer swings at an imaginary ball at about 10 to 12 repetitions per minute. The elastic offers resistance which causes significant muscle strengthening when the device is used regularly.

Another alternative construction is also seen in FIG. 7. A band 18 may be used to encircle one arm of the golfer to hold it in a relatively close position to the body during the swing. For a right handed golfer this would encircle the upper portion of the left arm. Band 18 may be permanently mounted to chest strap 2 or it may be attached as by velcro fasteners or snaps, so that it may optionally used or removed or may be used on either side. This option need not be used in association with the elastic means 26, 28.

Figure 9:
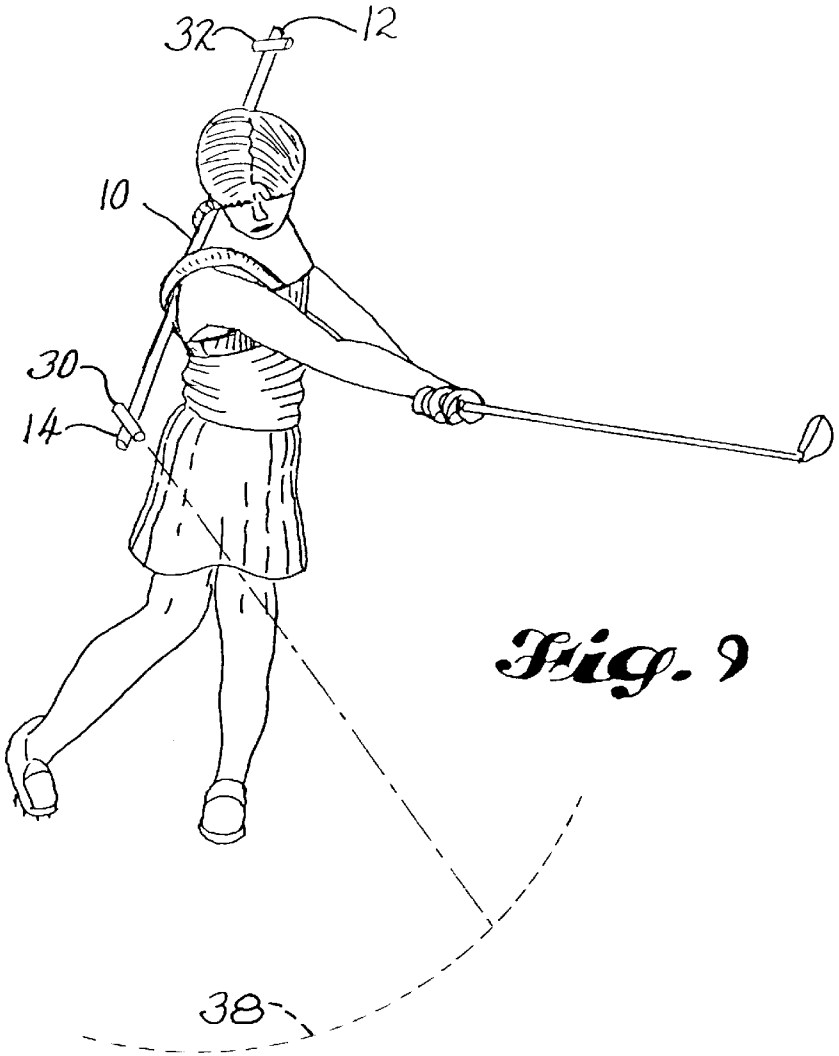
FIGS. 8 and 9 are front views of another embodiment that projects a visible light trace on the ground as a means of analyzing the golfer's swing.
Figure 8:
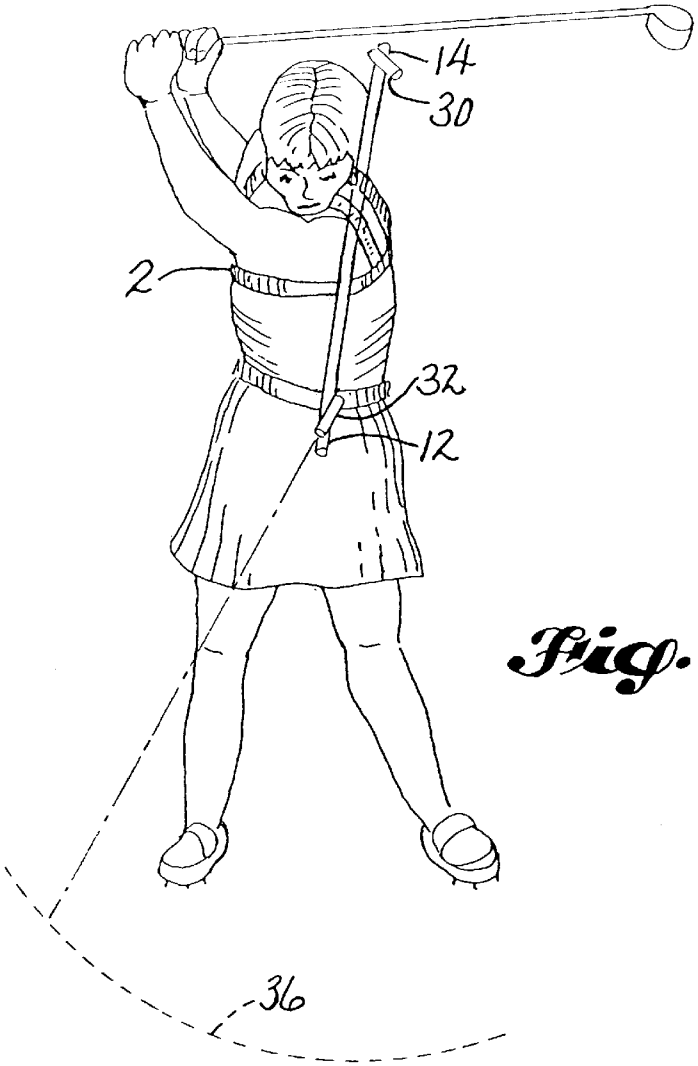
Figure 12:
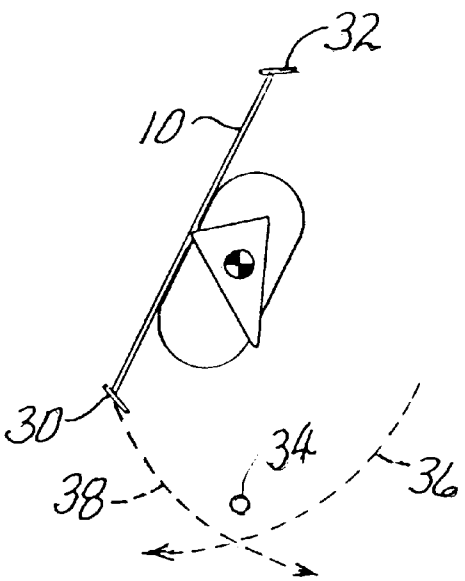
FIGS. 10–12 are diagrammatic views from above showing use of the embodiment of FIGS. 8 and 9.
Figure 11:
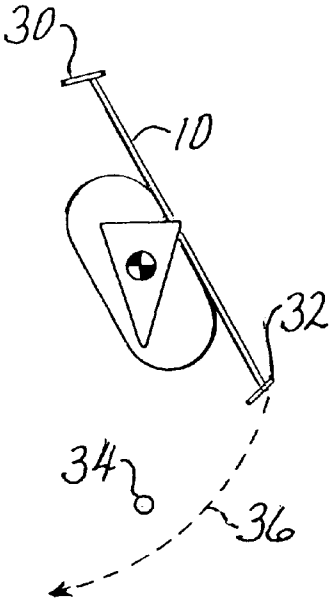
Figure 10:
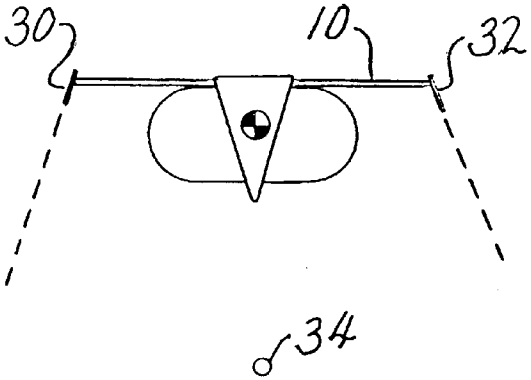

The availability of very inexpensive laser light pointers permits a useful modification of the device that has been described to this point. FIG. 8, which corresponds to FIG. 2, shows laser light pointers 30, 32 adjustably mounted at the left and right ends 14, 12 of bar 10. The laser pointers will be mounted so as to be adjustable in three dimensions, as by a simple ball joint not shown, so that they can be adjusted for the height and swing characteristics of the individual golfer. In use, they will be pointed at the ground so as to describe an arc as the swing progresses. FIG. 8 shows the light arc 36 described by pointer 32 during the backswing. In similar manner, FIG. 9, corresponding to FIG. 3, shows the arc 38 described by pointer 30 as the ball is hit and the follow through progresses. What the golfer actually sees using the laser pointer device is perhaps better shown in diagrammatic FIGS. 10–12, taken from above a right handed golfer. In FIG. 10 the golfer is addressing a real or imaginary ball 34. The trace on the ground of pointers 30 and 32 out of view at this point. As seen in FIG. 11, during the backswing the golfer sees the light trace 36 on the ground before him. During the forward swing shown in FIG. 12, as the club head approaches ball 34 and moves into the follow through, pointer 30 creates light trace 38. The two traces should have a point of intersection at or a short distance directly in front of ball 34. While this embodiment can be profitably used by a student alone, it is particularly useful as an instructional tool.

It will be understood by those skilled in the art that many variations can be made in the training device that have not been described or exemplified. These variations should be considered to fall within the purview of the invention if they fall within the scope of the following claims.

What is claimed is:

1. A training device to enable a golfer to develop a smooth and consistent swing which comprises:

a harness with a chest encircling band depending from shoulder straps, the shoulder straps having front and rear portions adapted to drape respectively over the chest and back of a user, the chest band having a closure means to enable a user to readily put the harness on for use; and a rigid bar situated transversely across the rear portion of the shoulder straps so that the bar lies behind the shoulders of the golfer in a position that does not interfere with a normal swing when the device is in use, each strap having an attachment means for retaining the bar, the bar being of a length and so positioned in the shoulder straps that when the device is in use the bar is essentially horizontal and not visible to a golfer addressing a ball, but one end becomes visible directly in front of the golfer at the peak of a correct back swing and the other end becomes visible in front of the golfer at the end of a correct follow through.

2. The training device of claim 1 in which the closure means is a buckle located on a front portion of the chest encircling band.

3. The training device of claim 1 in which the closure means is a velcro fastener located on a front portion of the chest encircling band.

4. The training device of claim 1 which further includes an auxiliary strap attached to the chest encircling band, said auxiliary strap located and sized so as to encircle one arm and maintain the arm in close proximity to the torso when the device is in use.

5. The training device of claim 1 which further includes elastic means attached at each end of the bar, said elastic means having proximal ends attached to the bar and having anchoring means at their distal ends which may be attached to fixed spaced apart points, whereby the training device may be used as an exerciser for coordination and muscle development.

6. The training device of claim 1 which further includes adjustable light pointers attached at each end of the bar, the pointers being useful to show a visible arc on the ground defining the golfer's swing.

* * * * *